US006484348B1

(12) United States Patent
Paterson et al.

(10) Patent No.: US 6,484,348 B1
(45) Date of Patent: Nov. 26, 2002

(54) VACUUM DEVICES HAVING INTEGRATED CORD STORAGE AND PIVOTABLE TOOL HOLDERS

(75) Inventors: Chris M. Paterson, Long Beach, MS (US); Paul A. Moshenrose, Ocean Springs, MS (US); Steven P. Irby, Gulfport, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/675,277

(22) Filed: Sep. 29, 2000

(51) Int. Cl.[7] ..... A47L 9/26
(52) U.S. Cl. ..... 15/323; 15/339
(58) Field of Search ..... 15/323, 339

(56) References Cited

U.S. PATENT DOCUMENTS

| | | | | | |
|---|---|---|---|---|---|
| 2,534,122 | A | * | 12/1950 | Hamala | 15/323 |
| 2,573,091 | A | * | 10/1951 | Brown, Jr. | 15/323 |
| 2,608,709 | A | * | 9/1952 | Benjamin | 15/323 |
| 2,974,343 | A | * | 3/1961 | Seyfried | 15/323 |
| 3,217,350 | A | * | 11/1965 | Waters et al. | 15/323 |
| 4,249,280 | A | | 2/1981 | Goodrich | 15/323 |
| 4,554,700 | A | * | 11/1985 | Lyman | 15/323 |
| 4,658,465 | A | * | 4/1987 | Keane et al. | 15/323 |
| D292,335 | S | | 10/1987 | Wareham et al. | D32/22 |
| 4,715,083 | A | * | 12/1987 | Harris et al. | 15/323 |
| 4,733,430 | A | | 3/1988 | Westergren | 15/339 |

(List continued on next page.)

OTHER PUBLICATIONS

Oreck Brochure, "Super Buster B.—Maxi–Power Compact," Jan., 1991.
Oreck Brochure, "Ironman—Model IM88 and IM98," Aug., 1996.
Oreck Brochure, "Power Brush Vacuum and Spot Dry Cleaner," Jan., 1998.
Oreck Brochure, "Simply Amazing—Compacts," Jan., 2000.

*Primary Examiner*—Theresa T. Snider
(74) *Attorney, Agent, or Firm*—Faegre & Benson LLP

(57) ABSTRACT

Vacuum devices having integrated cord storage and pivotable tool holders are disclosed. In one embodiment, a vacuum device includes a housing, an airflow propulsion device, and a power cord. The housing includes an outer surface having a recess disposed therein, the recess being sized to receive a plurality of loops of the power cord. First and second cord retainers are disposed within the recess and project outwardly from the housing, the first and second cord retainers being sized to retain the plurality of loops of the power cord. The outer surface may be a bottom surface of the apparatus. In another embodiment, the housing includes a cord mount disposed within the recess, the fixed end of the power cord being connected to the cord mount such that a localized portion of the power cord proximate the cord mount is directed approximately toward the first cord retainer. Alternately, the localized portion of the power cord may be inclined with respect to the base surface, or parallel with the base surface. In another embodiment, a vacuum apparatus includes a housing, an airflow propulsion device, and a tool holder pivotably attached to the housing proximate an outer surface thereof.

32 Claims, 5 Drawing Sheets

U.S. PATENT DOCUMENTS

| | | | | | |
|---|---|---|---|---|---|
| 4,733,431 | A | | 3/1988 | Martin | 15/339 |
| 4,761,850 | A | | 8/1988 | Romeo et al. | 15/323 |
| 4,763,382 | A | * | 8/1988 | Sumerau | 15/323 |
| D301,784 | S | | 6/1989 | Petralia et al. | D32/22 |
| 4,945,603 | A | * | 8/1990 | Herron, Jr. | 15/323 |
| 4,996,736 | A | * | 3/1991 | Nusser et al. | 15/323 |
| D316,167 | S | | 4/1991 | Petralia et al. | D32/22 |
| D337,909 | S | | 8/1993 | Furcron et al. | D6/553 |
| D339,433 | S | | 9/1993 | Stein et al. | D32/22 |
| 5,247,719 | A | * | 9/1993 | Wareham et al. | 15/323 |
| 5,276,939 | A | | 1/1994 | Uenishi | 15/319 |
| D346,052 | S | | 4/1994 | Saunders et al. | D32/22 |
| 5,309,600 | A | | 5/1994 | Weaver et al. | 15/328 |
| 5,367,741 | A | | 11/1994 | Hampton et al. | 15/323 |
| 5,390,392 | A | | 2/1995 | Thomas et al. | 15/339 |
| 5,515,572 | A | | 5/1996 | Hoekstra et al. | 15/319 |
| D379,692 | S | | 6/1997 | Abe | D32/22 |
| D387,517 | S | | 12/1997 | Abe et al. | D32/22 |
| 5,774,930 | A | | 7/1998 | Sommer et al. | 15/326 |
| 5,778,486 | A | | 7/1998 | Kim | 15/339 |
| D398,097 | S | | 9/1998 | Murphy et al. | D32/22 |
| D403,482 | S | | 12/1998 | Essex et al. | D32/331 |
| 5,850,666 | A | | 12/1998 | Farone et al. | 15/339 |
| D406,928 | S | | 3/1999 | Rowley et al. | D32/22 |
| 5,906,024 | A | | 5/1999 | Jailor et al. | 15/354 |
| 5,911,261 | A | | 6/1999 | Farone et al. | 15/416 |
| D413,187 | S | | 8/1999 | Wang et al. | D32/22 |
| D419,730 | S | | 1/2000 | Diebel et al. | D32/22 |
| 6,079,080 | A | | 6/2000 | Rutter et al. | 15/410 |
| 6,081,963 | A | | 7/2000 | Jailor et al. | 15/368 |

* cited by examiner

VACUUM DEVICES HAVING INTEGRATED CORD STORAGE AND PIVOTABLE TOOL HOLDERS

TECHNICAL FIELD

The present invention relates to cleaning devices, and more particularly, to vacuum devices having integrated cord storage and movable tool holders.

BACKGROUND OF THE INVENTION

Many contemporary cleaning devices are electrically powered. Such cleaning devices include vacuums, buffers, extractors, steam cleaners, and other similar devices. The electrical power is typically supplied to the cleaning device through a power cord. When not in use, the power cord may be removed from the cleaning device, or may be wrapped about a portion of the cleaning device for transport and storage.

FIG. 1 is an isometric view of a vacuum device 10 in accordance with the prior art. As is well known, the vacuum device 10 includes a housing 12 having an intake port 14 coupled to a hose 16, and an exhaust port 18. A vacuum unit 20 (not shown) is disposed within the housing 12. A power cord 22 is attached to the housing 12 for providing electrical power to the vacuum unit 20. The housing 12 includes a handle 24 for carrying the vacuum device 10. A control switch 26 is disposed in the handle 24 for controlling the power supplied to the vacuum unit 20. A pair of cord hooks 28 project outwardly from a lateral side of the housing 12 for wrapping the power cord 22 when not in use.

In use, an operator grips the handle 24 and actuates the control switch 26 to transmit power supplied by the power cord 22 to the vacuum unit 20. As will be understood by persons of ordinary skill in the art, the vacuum unit 20 creates suction within the hose 16, drawing a particulate-laden airstream into the housing 12 through the intake port 14. The particulate-laden airstream may then pass through a removable filter element (e.g. a disposable paper bag) where particulates may be filtered from the particulate-laden airstream and captured for later disposal. The vacuum unit 20 then exhausts a filtered airstream out of the housing 12 through the exhaust port 18. After using the vacuum device 10, the operator may prepare the device for storage or transport by successively winding the power cord 22 about the cord hooks 28, placing the power cord 22 in a stowed position (FIG. 1).

The vacuum device 10 may also include a tool holder 30 attached to the housing 12. The tool holder 30 includes retaining projections 34 that may be engaged with one or more vacuum tools 32 (e.g. nozzles, brushes, etc.) to engage and retain the vacuum tools 32 until they are needed. The vacuum tools 32 may be attached to an attachment end 17 of the hose 16 for different cleaning applications.

Although highly beneficial results have been achieved, some aspects of the vacuum device 10 may be improved. In the embodiment shown in FIG. 1, the vacuum device 10 is a hand-held device that may be used in a variety of applications. As such, it may be desirable to further optimize the portability and versatility of the vacuum device 10.

SUMMARY OF THE INVENTION

The present invention is directed to vacuum devices having integrated cord storage and pivotable tool holders. In one aspect, a vacuum apparatus includes a housing, an airflow propulsion device, and a power cord. The housing includes an outer surface having a recess disposed therein, the recess being sized to receive a plurality of loops of the power cord. First and second cord retainers are disposed within the recess and project outwardly from the housing, the first and second cord retainers being sized to retain the plurality of loops of the power cord. The outer surface may be a bottom surface of the apparatus. Because the power cord may be disposed within the recess on the bottom surface, the center of gravity of the apparatus may be lowered, thereby improving the stability of the vacuum apparatus for transport and storage.

In another aspect, the housing includes a cord mount disposed within the recess, the fixed end of the power cord being connected to the cord mount such that a localized portion of the power cord proximate the cord mount is directed approximately toward the first cord retainer. Alternately, the localized portion of the power cord may be inclined with respect to the base surface, or parallel with the base surface. In this way, bending stresses within the localized portion may be reduced or eliminated.

In another aspect, a vacuum apparatus includes a housing, an airflow propulsion device, and a tool holder pivotably attached to the housing proximate an outer surface thereof. Because the tool holder is pivotable, the versatility of the vacuum device may be improved.

DETAILED DESCRIPTION OF THE INVENTION

The present invention is generally directed to vacuum devices having integrated cord storage and pivotable tool holders. Many specific details of certain embodiments of the invention are set forth in the following description and in FIGS. 2–6 to provide a thorough understanding of such embodiments. One skilled in the art will understand, however, that the present invention may have additional embodiments, or that the present invention may be practiced without several of the details described in the following description.

Figure 1:
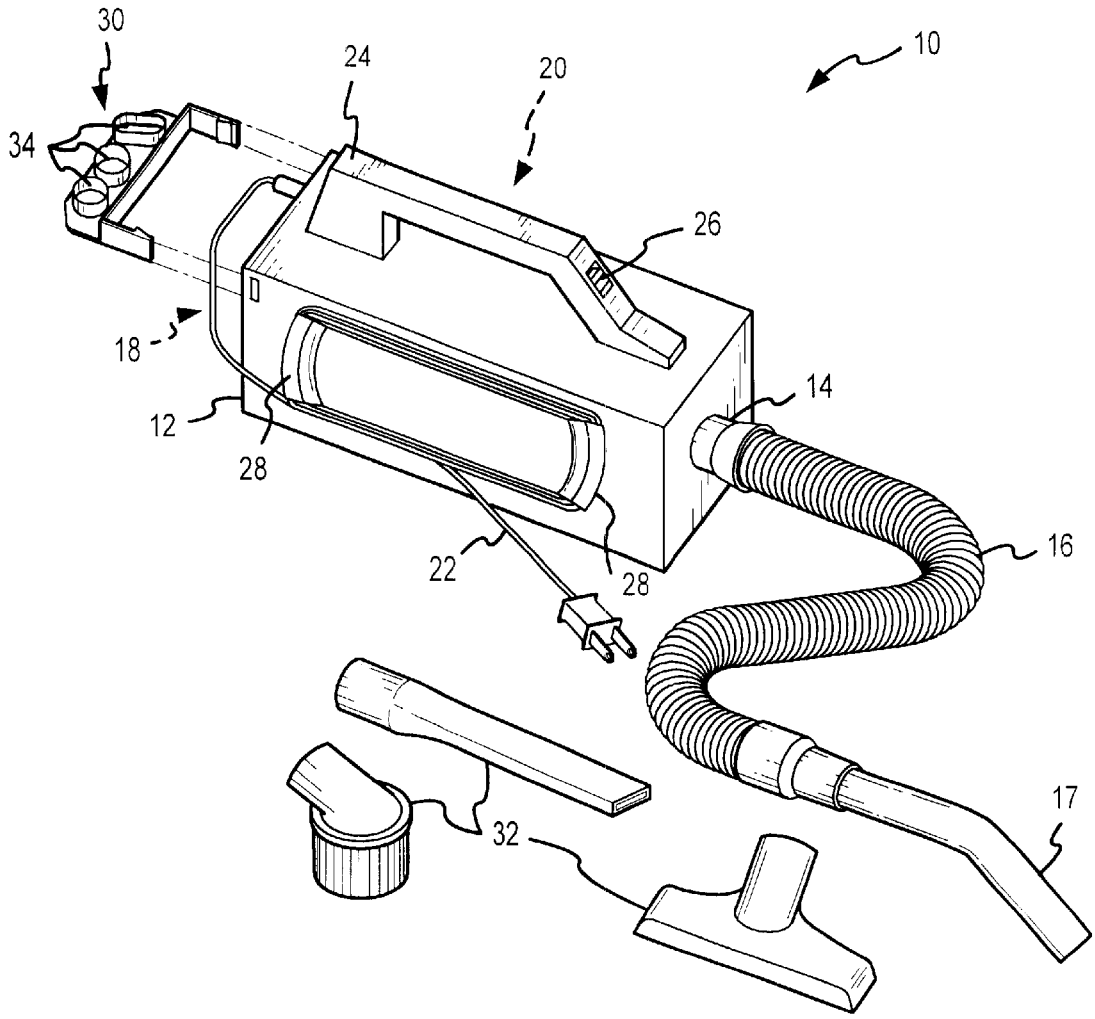
(PRIOR ART) FIG.1
FIG. 1 is an isometric view of a vacuum machine with accessories in accordance with the prior art.
Figure 2:
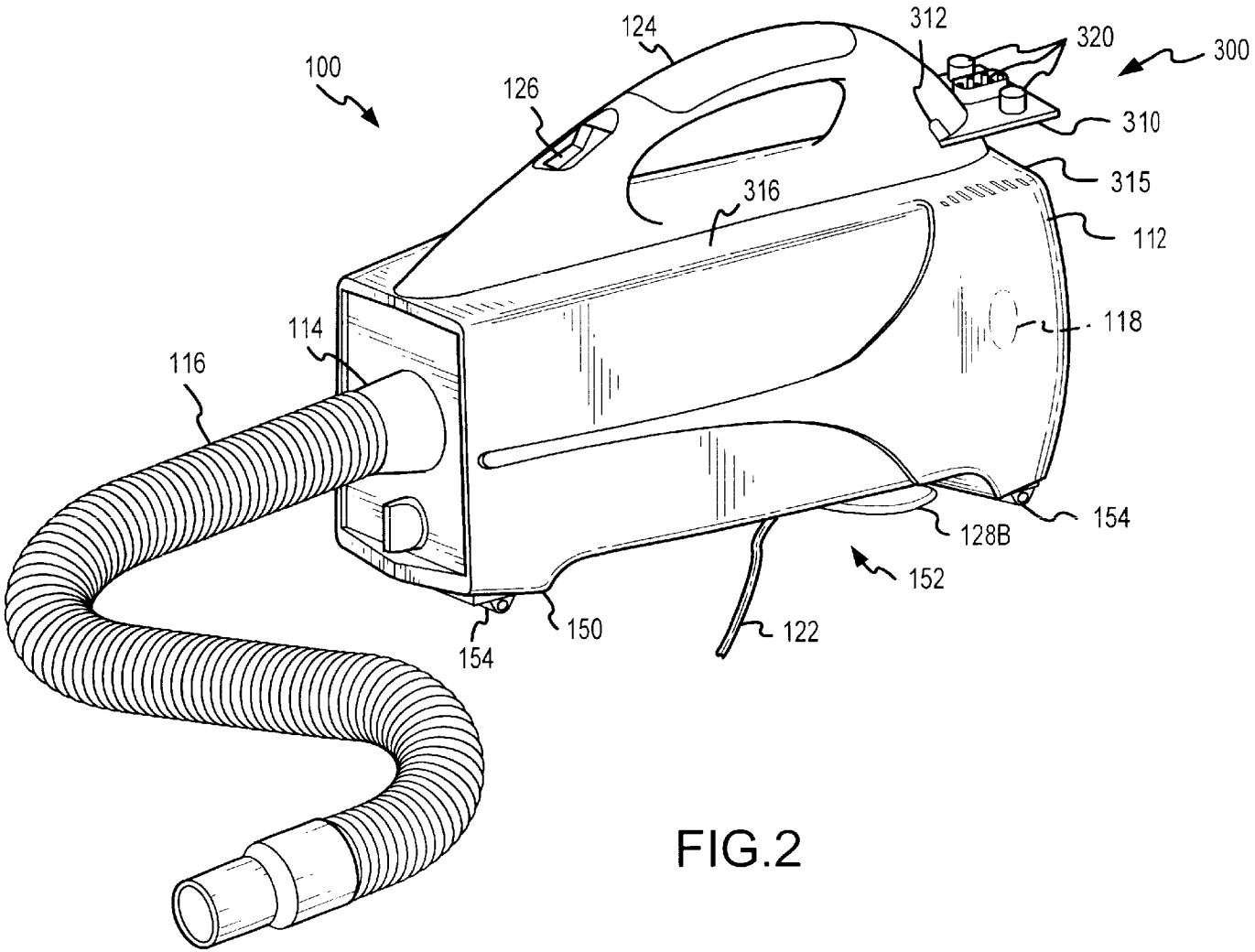
FIG. 2 is an isometric view of a vacuum machine in accordance with an embodiment of the invention.
Figure 3:
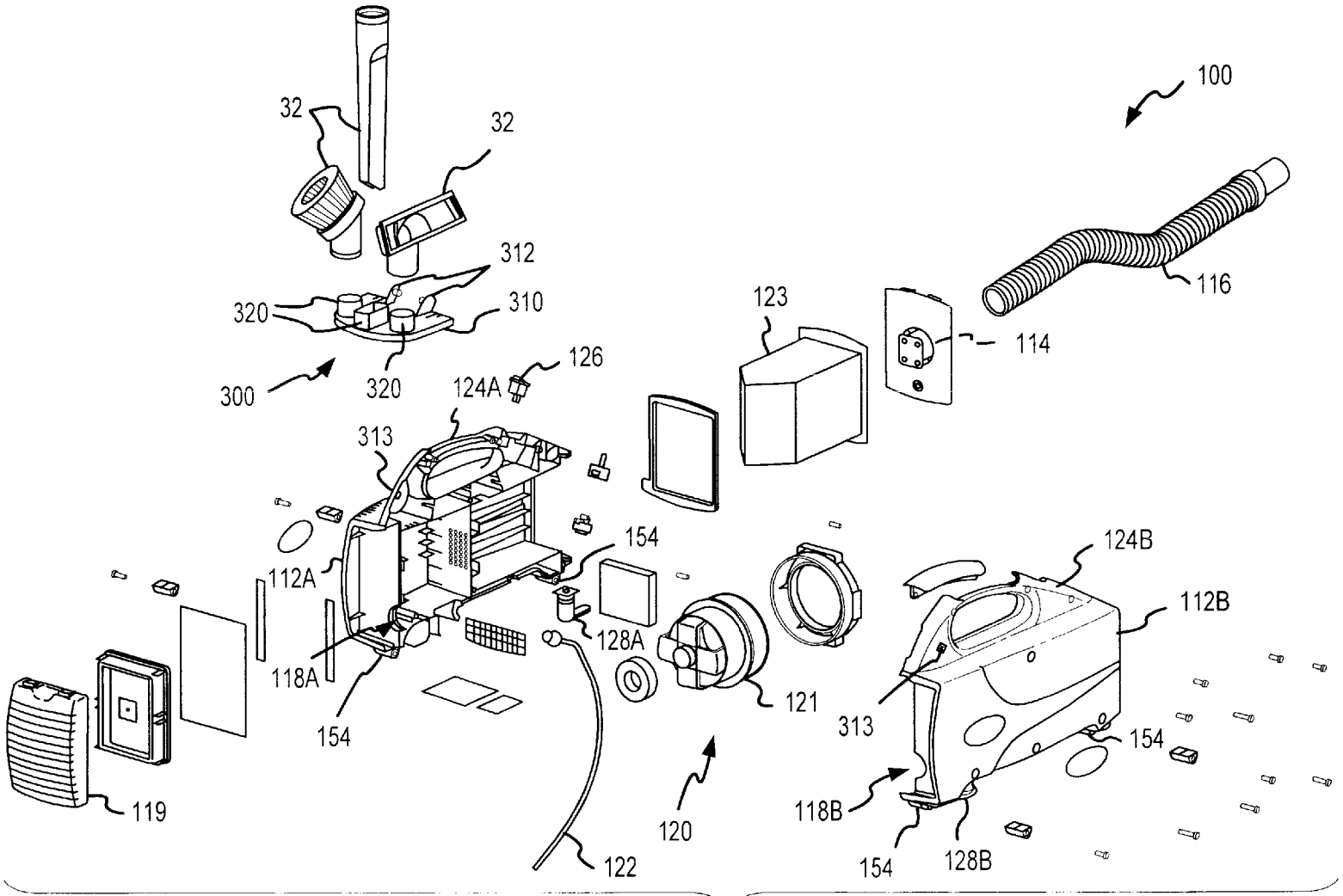
FIG. 3 is an isometric, exploded view of the vacuum machine of FIG. 2.
Figure 4:
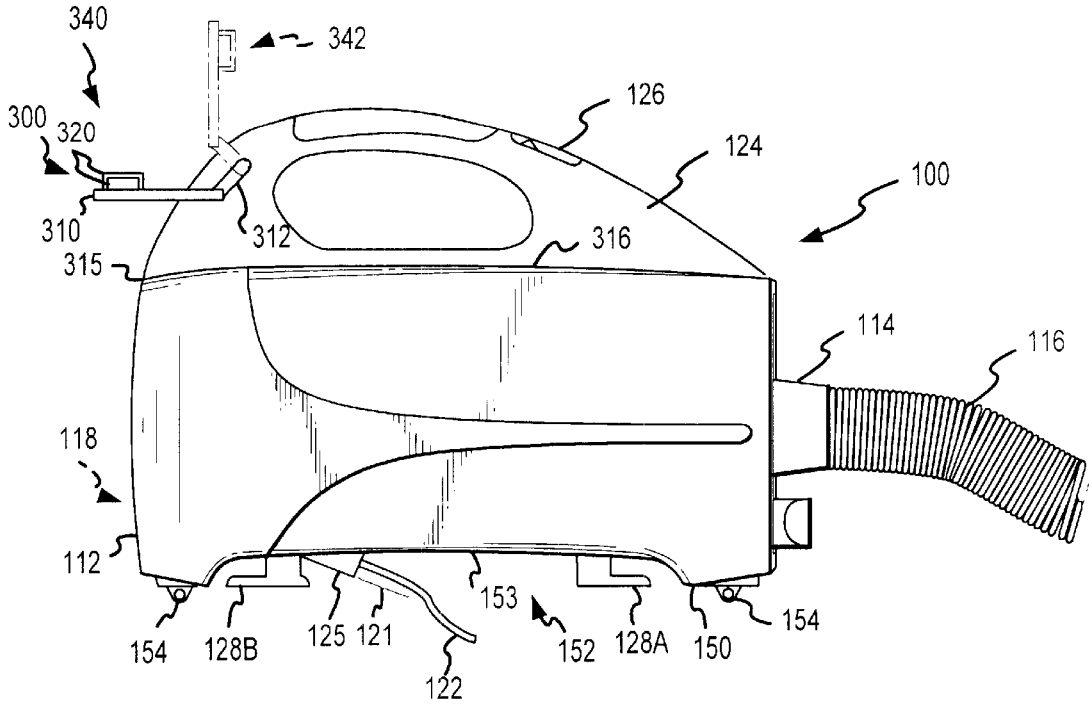
FIG. 4 is a side elevational view of the vacuum machine of FIG. 2.
Figure 5:
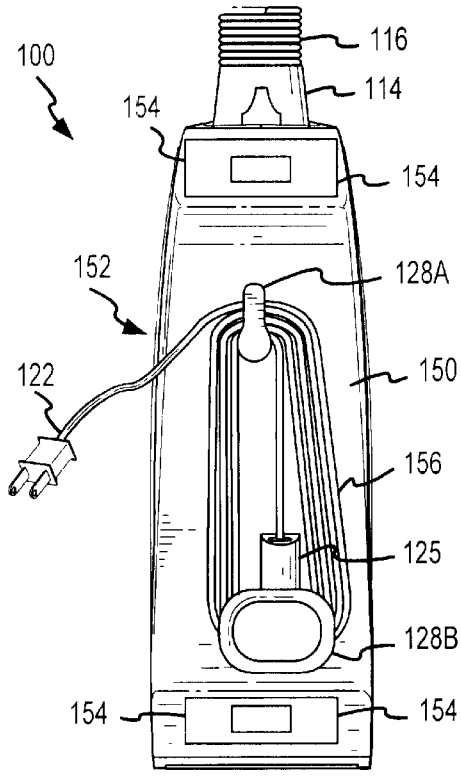
FIG. 5 is a bottom plan view of the vacuum machine of FIG. 2.

FIGS. 2 and 3 are isometric and isometric exploded views, respectively, of a vacuum machine 100 in accordance with an embodiment of the invention. FIGS. 4 and 5 are side elevational and bottom plan views, respectively, of the vacuum machine 100 of FIG. 2. As best shown in FIGS. 2 and 4, the vacuum device 100 includes a housing 112 having a bottom surface 150 with a recess 152 disposed therein. As more fully described below, the recess 152 is sized to receive and store a plurality of loops of a power cord 122.

Referring to FIGS. 2 and 3, the housing 112 includes an intake port 114 coupled to a hose 116, and an exhaust port 118 (shown as 118A and 118B in FIG. 3). An exhaust grill 119 is disposed over the exhaust port 118. A vacuum unit 120 having an electric motor 121 (FIG. 3) is disposed within the housing 112. A control switch 126 is disposed in a handle 124 on the housing 112 for controlling the power supplied to the vacuum unit 120. A filter element 123 (e.g. a disposable vacuum bag) is positioned within the housing 112 to receive a particulate-laden airstream through the intake port 114.

As best shown in FIGS. 4 and 5, a power cord 122 is attached to a cord mount 125 disposed on the bottom surface 150 of the housing 112. In this embodiment, the cord mount 125 is disposed within the recess 152, and is connected to the power cord 122 such that a localized portion of the power cord 122 proximate the cord mount 125 is inclined outwardly with respect to the bottom surface 150 (FIG. 4). Alternately, the power cord 122 may be attached to the cord mount 125 such that the localized portion 121 is approximately parallel to the bottom surface 150 of the housing 112, or a base surface 153 (FIG. 4) of the recess 152, or both. The power cord 122 is attached to the cord mount 125 such that the localized portion 121 projects approximately toward the forward the forward cord retainer 128A.

The housing 112 further includes forward and rearward cord retainers (or "hooks") 128A, 128B that project outwardly from the base surface 153 of the recess 152. Supports (or "feet") 154 project downwardly from the bottom surface 150 proximate the recess 152 to support the vacuum device 100 on a floor or other surface. In this embodiment, the cord retainers 128A, 128B project outwardly to a distance approximately equal to the depth of the recess 152 (see FIG. 4). Alternately, the cord retainers 128A, 128B may project outwardly by greater or lesser amounts. Preferably, the cord retainers 128A, 128B do not project beyond the supports 154.

To operate the vacuum device 100, an operator may grip the handle 124 and actuate the control switch 126 to transmit power supplied by the power cord 122 to the vacuum unit 120. The vacuum unit 120 creates suction within the hose 116, drawing a particulate-laden airstream into the housing 112 through the intake port 114. The particulate-laden airstream then passes into the filter element 123 where particulates are filtered and captured for later disposal. The vacuum unit 120 then exhausts a filtered airstream out of the housing 112 through the exhaust port 118 and the exhaust grill 119 (FIG. 3).

To prepare the vacuum device 100 for storage or transport, the operator may wind successive loops of the power cord 122 about the cord retainers 128A, 128B. First, the power cord 122 is pulled tightly from the cord mount 125 to the forward cord retainer 128A. The power cord 122 is then partially wrapped around the forward cord retainer 128A and back to the rearward cord retainer 128B. The power cord 122 is then partially wrapped around the rearward cord retainer 128B, and the process is repeated until a plurality of loops of the power cord 122 are successively wrapped about the cord retainers 128A, 128B, placing the power cord 122 is a stowed position 156 (FIG. 5).

The vacuum device 100 advantageously provides improved stability characteristics over prior art vacuum devices. Because the power cord 122 is disposed within the recess 152 on the bottom surface 150, and because the power cord 122 may have significant mass as compared to the vacuum device 100 as a whole, the center of gravity of the vacuum device 100 is lowered, and the weight of the power cord 122 is more evenly distributed on the supports 154, compared with prior art devices. The vacuum device 100 is therefore less likely to tip over and scratch or mar the housing 112 or other components of the vacuum device 100.

Another advantage is that when the power cord 122 is placed in the stowed position 156, the power cord 122 is subjected to less bending stresses. For example, when the operator begins wrapping the power cord 122 about the cord retainers 128A, 128B, the power cord 122 is pulled between the cord mount 125 and the forward cord retainer 128A. This action subjects the localized portion 121 of the power cord 122 to primarily axial, tension forces rather than lateral bending forces. Because the power cord 122 is attached to the cord mount 125 such that the localized portion 121 projects approximately toward the forward cord retainer 128A, the forces generated within the localized portion 121 of the power cord 122 by the operator during wrapping of the cord are predominantly axial forces. The bending stresses that may fatigue and ultimately damage the power cord 122 within the localized portion 121 are thereby reduced or eliminated.

Referring again to FIGS. 2 and 3, the vacuum device 100 may also include a pivotable tool holder 300. The tool holder 300 includes a base 310 having first and second arms 312 that pivotably engage into a pair of pivot holes 313 disposed in opposing lateral surfaces of the handle 124 (FIG. 3). A plurality of retaining members 320 project from the base 310 that are engageable with one or more vacuum tools 32 (FIG. 3). As shown in FIG. 4, the tool holder 300 is pivotable between a first position 340 and a second position 342. In this embodiment, with the vacuum device 100 resting on the supports 154, the base 310 is in an approximately horizontal position when the tool holder 300 is in the first position 340, and in an approximately vertical position when the tool holder 300 is in the second position 342.

Figure 6:
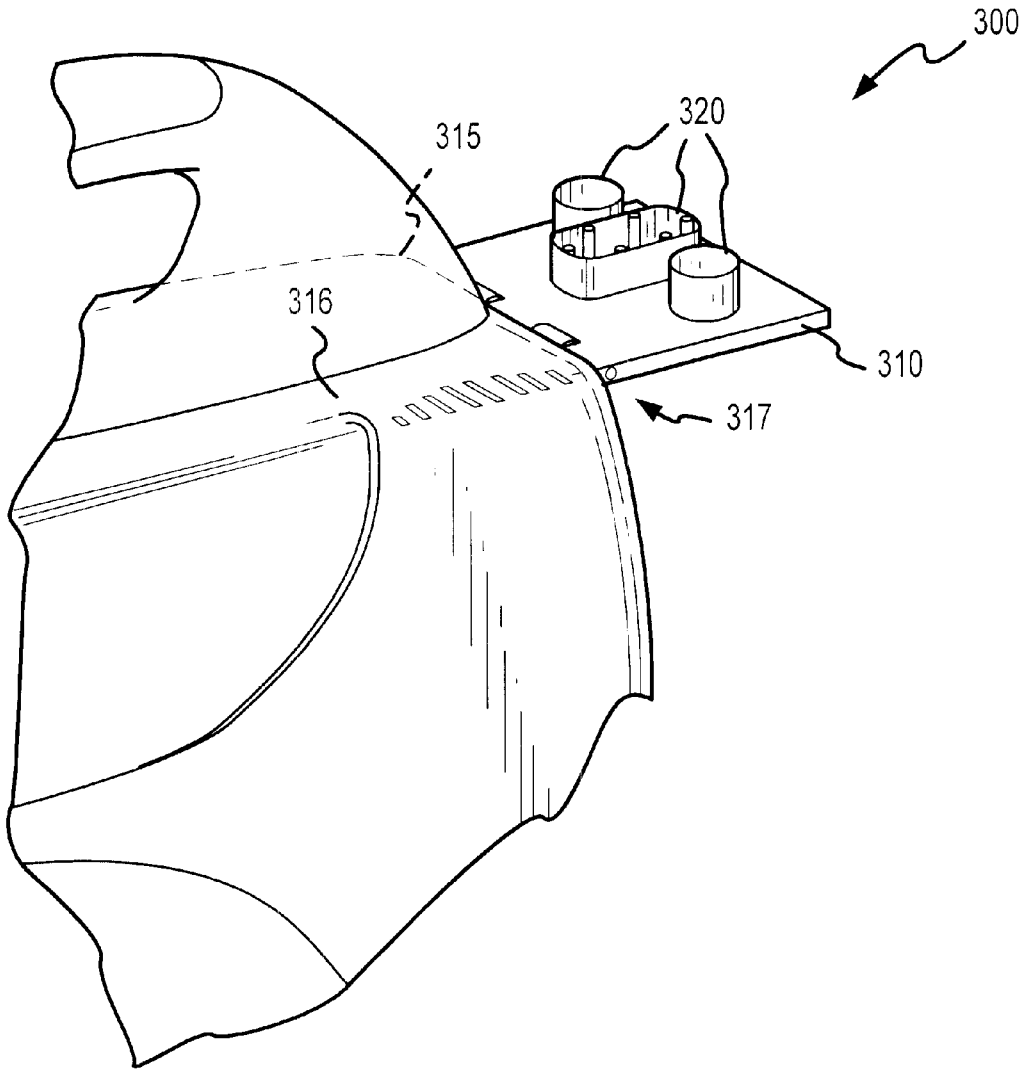
FIG. 6 is an enlarged, partial isometric view of a rear portion of a vacuum machine in accordance with an alternate embodiment of the invention.

Although the base 310 is shown as being pivotably connected to the handle 124 by a pair of arms 312, a variety of alternate embodiments are possible. For example, the arms 312 may be eliminated, and the base 310 may be attached to the handle 124 by a hinge. Alternately, as shown in FIG. 6, the base 310 may be pivotably attached along a back edge 315 of an upper surface 316 of the housing 112 by a hinge 317. In further embodiments, the tool holder 300 may be pivotably attached at other locations on the housing 112, may have a greater or fewer number of tool retaining members 320, and may be pivotably through a larger or smaller range of motion than that shown in FIG. 4.

The tool holder 300 may be attached to the housing 112 using a variety of known attachment mechanisms that prevent the tool holder 300 from rotating freely between the first and second positions 340, 342, but that allow the tool holder 300 to be rotated between the first and second positions 347, 342 as desired by the operator, such as, for example, by the application of sufficient force, or by the actuation of a release mechanism, or by other similar action. For example, a ball detent could be used as a restraining mechanism to maintain the tool holder 300 in the first and second positions 340, 342 (or in any intermediate position therebetween) until rotated out of such positions by the application of a sufficient pivoting force. Other known means may be used for maintaining the tool holder 300 in the desired positions.

The pivotable tool holder 300 may advantageously increase the versatility of the vacuum device 100. For example, in operation, when the vacuum device 100 is positioned on the supports 154 (FIG. 4), the tool holder 300 may be positioned in the first position 340, providing easy access to the vacuum tools 32 engaged on the retaining members 320. For storing the vacuum device 100, the operator may pivot the tool holder 300 into the second position 342, allowing the exhaust grill 119 to be positioned proximate a wall or other surface and improving the storability of the vacuum device 100 within, for example, a closet, box, or other storage compartment. Alternately, if the operator desires to rest the vacuum device 100 on the exhaust grill 119, such as for removal or installation of the filter element 123 (FIG. 3), the tool holder 300 may be pivoted into the second position 342 where it will not be damaged and where it will not interfere with the engagement of the exhaust grill 119 on the support surface. Thus, the versatility and ease of operation of the vacuum device 300 may be improved.

Although the above-described embodiments have been shown and described in terms of an exemplary hand-held vacuum device, it will be understood that the teachings of the foregoing invention disclosure are applicable to a wide variety of cleaning devices. Therefore, the teachings of the foregoing disclosure will be understood to be applicable to a variety of floor care devices, including, for example, upright and canister vacuums, buffers, extractors, steam cleaners, sweepers, carpet shampooers and other similar devices.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other vacuum devices having integrated cord storage and pivotable tool holders, and not just to the embodiments described above and shown in the accompanying figures. Accordingly, the scope of the invention should be determined from the following claims.

What is claimed is:

1. A vacuum apparatus, comprising:

a housing having an interior region, an intake opening disposed through the housing and leading to the interior region, and an exhaust opening disposed through the housing and leading to the interior region;

an airflow propulsion device disposed within the interior region and proving an intake airflow into the interior region through the intake opening and an exhaust airflow out of the interior region through the exhaust opening;

a power cord having a fixed end connected to the housing and a free end spaced apart from the fixed end; and wherein the housing includes an outer surface having a recess disposed therein, the recess being sized to receive a plurality of loops of the power cord, and first and second cord retainers projecting outwardly from the housing within the recess, the first and second cord retainers being adapted to receive the plurality of loops of the power cord in such a manner as to put the power cord in tension when wound by a user.

2. The vacuum apparatus according to claim 1 wherein the housing includes a cord mount disposed within the recess, the fixed end of the power cord being connected to the cord mount such that a localized portion of the power cord proximate the cord mount is directed approximately toward the first cord retainer.

3. The vacuum apparatus according to claim 2 wherein the housing includes a base surface disposed within the recess, the localized portion of the power cord being inclined with respect to the base surface.

4. The vacuum apparatus according to claim 1 wherein the first and second cord retainers project outwardly to a height no greater than the depth of the recess.

5. The vacuum apparatus according to claim 1 wherein the outer surface includes a plurality of supports engageable with a bottom surface.

6. The vacuum apparatus according to claim 5 wherein the first and second cord retainers do not project beyond the plurality of supports.

7. The vacuum apparatus according to claim 1, further comprising a tool holder movably attached to the housing proximate a second outer surface thereof, the tool holder being movable with respect to the second outer surface.

8. The vacuum apparatus according to claim 7 wherein the tool holder includes a substantial flat base and wherein the base is approximately parallel with a second outer surface when the tool holder is in a first position, the base being approximately perpendicular to the second outer surface when the tool holder is in a second position.

9. The vacuum apparatus according to claim 7 wherein the base includes a pair of support arms extending therefrom, the support arms being movably coupled to first and second lateral surfaces of the housing.

10. The vacuum apparatus according to claim 7 wherein the tool holder is hingeably attached to an edge of the housing.

11. The vacuum apparatus according to claim 7 wherein the tool holder is pivotably attached to an edge of the housing.

12. A vacuum apparatus comprising:

a housing having an interior region, an intake opening disposed through the housing and leading to the interior region, and an exhaust opening disposed through the housing and leading to the interior region;

an airflow propulsion device disposed within the interior region and providing an intake airflow into the interior region through the intake opening and an exhaust airflow out of the interior region through the exhaust opening; and a tool holder external to an outer surface of the housing and moveably attached to the housing proximate the outer surface and being movable to a plurality of orientations with respect to the outer surface, the tool holder having at least one retaining member adapted to releasably retain at least one tool and wherein the at least one retaining member is both external to the interior region and accessible to the user in any of the plurality of orientations.

13. The vacuum apparatus according to claim 12 wherein the tool holder includes a substantially flat base, the base being approximately parallel with a second outer surface when the tool holder is in a first position, and approximately perpendicular to the second outer surface when the tool holder is in a second position.

14. The vacuum apparatus according to claim 12 wherein the tool holder includes a substantially flat base, the base being approximately horizontal when the tool holder is i n a first position, and approximately perpendicular to a second outer surface when the tool holder is in a second position.

15. The vacuum apparatus according to claim 12 wherein the tool holder includes a pair of support arms extending therefrom, the support arms being movably coupled to first and second lateral surfaces of the housing.

16. The vacuum apparatus according to claim 15 wherein the first and second lateral surfaces are disposed on a handle of the housing.

17. The vacuum apparatus according to claim 12 wherein the tool holder is hingeably attached to an edge of the housing.

18. The vacuum apparatus according to claim 12, further comprising a power cord having a fixed end connected to the housing and a free end spaced apart from the fixed end, and wherein the housing includes a second outer surface having a recess disposed therein, the recess being sized to receive a plurality of loops of the power cord, and first and second cord retainers projecting outwardly from the housing within the recess, the first and second cord retainers being sized to at least partially retain the plurality of loops.

19. The vacuum apparatus according to claim 18 wherein the housing includes a cord mount disposed within the recess, the fixed end of the power cord being connected to the cord mount such that a localized portion of the power cord proximate the cord mount is directed approximately toward the first cord retainer.

20. The vacuum apparatus according to claim 18 wherein the first and second cord retainers do not project beyond the recess.

21. The vacuum apparatus according to claim 12 wherein the tool holder is pivotably attached to an edge of the housing.

22. A housing for a cleaning apparatus, comprising:

an outer shell;

a power cord having a fixed end connected to the outer shell and a free end spaced apart from the fixed end; and wherein the outer shell includes an outer surface having a recess disposed therein, and first and second cord retainers projecting outwardly from the housing within the recess, the recess being sized to receive a first plurality of loops of the power cord, the first and second cord retainers being adapted to receive a second plurality of loops of the power cord in such a manner as to put the power cord in tension when wound by a user.

23. The housing according to claim 22 wherein the first plurality of loops is equal to the second plurality of loops.

24. The housing according to claim 22 wherein the first plurality of loops is less than the second plurality of loops.

25. The housing according to claim 22 wherein the outer shell includes a cord mount disposed within the recess, the fixed end of the power cord being connected to the cord mount such that a localized portion of the power cord proximate the cord mount is directed approximately toward the first cord retainer.

26. The housing according to claim 22 wherein the outer shell includes a base surface disposed within the recess, with a localized portion of the power cord being inclined with respect to the base surface.

27. The housing according to claim 22 wherein the first and second cord retainers project outwardly to a distance no greater than the depth of the recess.

28. The housing according to claim 22 wherein the outer surface includes a plurality of supports engageable with a support surface, the first and second cord retainers projecting outwardly a distance no greater than the ends of the supports.

29. The housing according to claim 22, wherein the outer shell includes an interior region, an intake opening disposed through the outer shell and leading to the interior region, and an exhaust opening disposed through the outer shell and leading to the interior region, the housing further comprising an airflow propulsion device disposed within the interior region and providing an intake airflow into the interior region through the intake opening and an exhaust airflow out of the interior region through the exhaust opening.

30. A method of retaining a power cord of a cleaning device, comprising:

providing a cleaning device housing having a recess disposed therein, the recess being sized to receive a plurality of loops of the power cord, the housing further having first and second cord retainers disposed within the recess and projecting outwardly from the cleaning device housing; and wrapping the plurality of loops about the first and second cord retainers such that the plurality of loops are substantially disposed within the recess, thereby retaining the power cord.

31. The method of claim 30 wherein the first and second cord retainers do not project beyond the depth of the recess, the wrapping of the plurality of loops comprising wrapping the plurality of loops about the first and second cord retainers such that the plurality of loops are entirely disposed within the recess.

32. The method of claim 30 wherein the housing includes a cord mount disposed within the recess, the power cord being attached to the cord mount, and wherein the wrapping of the plurality of loops includes substantially axially tensioning a localized portion of the power cord proximate the cord mount.

* * * * *